US006324874B2

(12) United States Patent
Fujimoto

(10) Patent No.: US 6,324,874 B2
(45) Date of Patent: Dec. 4, 2001

(54) PILE SOCK

(75) Inventor: Souich Fujimoto, Kitakyushu (JP)

(73) Assignee: Fujimoto Corporation, Fukuoka (JP)

( * ) Notice: Subject to any disclaimer, the term of this patent is extended or adjusted under 35 U.S.C. 154(b) by 0 days.

(21) Appl. No.: 09/828,125

(22) Filed: Apr. 9, 2001

(30) Foreign Application Priority Data

Apr. 10, 2000 (JP) ..... 12-107629

(51) Int. Cl.[7] ..... A41B 11/00
(52) U.S. Cl. ..... 66/185; 66/178 R; 2/239
(58) Field of Search ..... 66/178 R, 182, 66/185, 183, 184, 186, 187; 2/239, 241

(56) References Cited

U.S. PATENT DOCUMENTS 4,194,249 * 3/1980 Thorneburg ..... 66/185
4,253,317 * 3/1981 Howard et al. ..... 66/185
4,255,949 * 3/1981 Thorneburg ..... 66/185
4,615,188 * 10/1986 Hursh et al. ..... 66/185
4,732,015 * 3/1988 Abrams et al. ..... 66/185
4,898,007 * 2/1990 Dahlgren ..... 66/185
5,307,522 * 5/1994 Thorneburg et al. ..... 66/185
5,335,517 * 8/1994 Thorneburg et al. ..... 66/185
5,603,232 * 2/1997 Thorneburg ..... 66/185
5,791,163 * 8/1998 Thorneburg ..... 66/185
6,021,527 * 2/2000 Lessard ..... 66/185

* cited by examiner

*Primary Examiner*—Danny Worrell
(74) *Attorney, Agent, or Firm*—Kubovcik & Kubovcik

(57) ABSTRACT

The present invention provides a pile sock which can lighten a sense of tiredness and has improved air permeability. A sole portion of the pile sock is knitted almost thoroughly in pile stitches. The sock is excellent in the cushioning properties and able to reduce load to a foot. It also has good sweat-absorption characteristics. A toe-side section of the pile sock works effectively to prevent slippage. An arch region of the sole portion has a smaller area of the pile stitch segments than an area of the plain stitch segments in comparison with a ground contact region of the sole portion. Arranging the plain stitch segments and the pile stitch segments in a lattice pattern allows a sense of stimulation and air permeability to be uniformly provided.

2 Claims, 2 Drawing Sheets

PILE SOCK

FIELD OF THE INVENTION

The present invention relates to a pile sock knitted almost thoroughly in pile stitches.

DESCRIPTION OF THE PRIOR ART

As for a conventional pile sock categorized into this kind is well known, for example, a pile sock disclosed in Japan Utility Model Laid-open Publication No. Sho 58-68904. This pile sock is suitable to be used in playing tennis or the like, because it has such a pile texture that has been made thinner in a region corresponding to an arch of a foot than in the other regions. Consequently, a bottom portion of the sock body is supposed to fit to sole of a foot, thus to prevent the sock from slipping out of place during physical exercise.

Such conventional sock, however, has had all region corresponding to the sole uniformly knitted in the pile stitches. As a result, such sock has been poor in air permeability as a whole and tended to compress whole sole of a foot by the pile stitches. Especially when used in physical exercise, such sock has caused a user to feel compressed strongly over the sole of the foot and to feel tired.

In the light of above problems, through an energetic research, the inventor of the present invention has obtained a knowledge below. That is, in a pile sock, the sole portion thereof should be composed of a ground contact region and a ground non-contact region, each of which is required to have a different function from other. The ground contact region should focus on good cushioning properties and strength, while the ground non-contact region should require the air permeability and the reduced sense of compression. The present invention has been accomplished based on this knowledge.

Accordingly, an object of the present invention is to provide a pile sock which can lighten a sense of tiredness and improve the air permeability.

Another object of the present invention is to provide a pile sock which has a function for preventing slippage as well as excellent cushioning properties.

SUMMARY OF THE INVENTION

An invention defined by claim 1 is a pile sock having a sole portion comprising: a toe-side section knitted in pile stitches; a heel-side section knitted in pile stitches; and an intermediate section arranged between said toe-side section and said heel-side section, said intermediate section comprising an arch region and a ground contact region, said pile sock characterized in that said intermediate section is knitted so that pile stitch segments and plain stitch segments are distributed as mixed over said section, wherein said arch region has a larger area of the plain stitch segments than an area of the pile stitch segments, while said ground contact region has a larger area of the pile stitch segments than an area of the plain stitch segments.

An invention defined by claim 2 is a pile sock, in which said intermediate section is knitted so that the pile stitch segments and the plain stitch segments are arranged in a lattice pattern.

According to the inventions disclosed in claims 1 and 2, since the sole portion of the pile sock has been knitted in pile stitches as a whole, it is excellent in the cushioning properties and is able to reduce a load to a foot. It also has good sweat-absorption characteristics. In addition, the toe-side section of the pile sock works effectively to prevent slippage. Still further, since the arch region of the sole portion has the smaller area of the pile stitch segments than the area of the plain stitch segments in comparison with the ground contact region of the sole portion, said pile sock is superior to a conventional sock in providing a sense of stimulation in sole of a foot and also a sense of fitness upon wearing the sock. At the same time, the pile sock according to the present invention generally produces a superior effect in the air permeability to the conventional one. Owing to these, said sock can reduce the exhaustion during wearing thus to be well suited for physical exercise, for example, walking. Further, since the plain stitch segments and the pile stitch segments are arranged in a lattice pattern, said sock allows the sense of stimulation and the air permeability to be provided uniformly.

DESCRIPTION OF THE PREFERRED EMBODIMENTS

An embodiment of the present invention will now be described with reference to the attached drawings.

Figure 1:
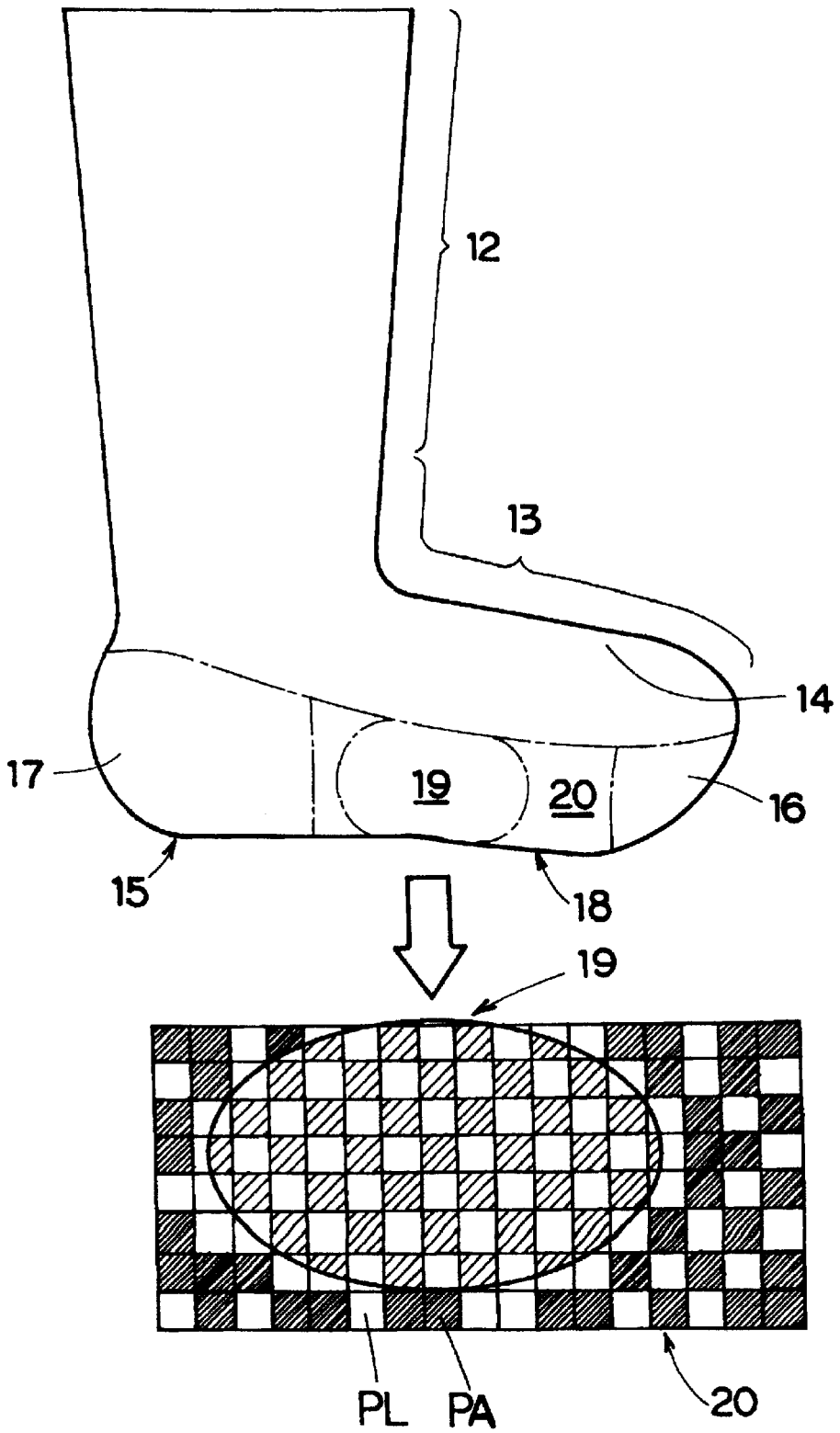
FIG. 1 is a schematic side elevational view of a pile sock according to an embodiment of the present invention.
Figure 2:
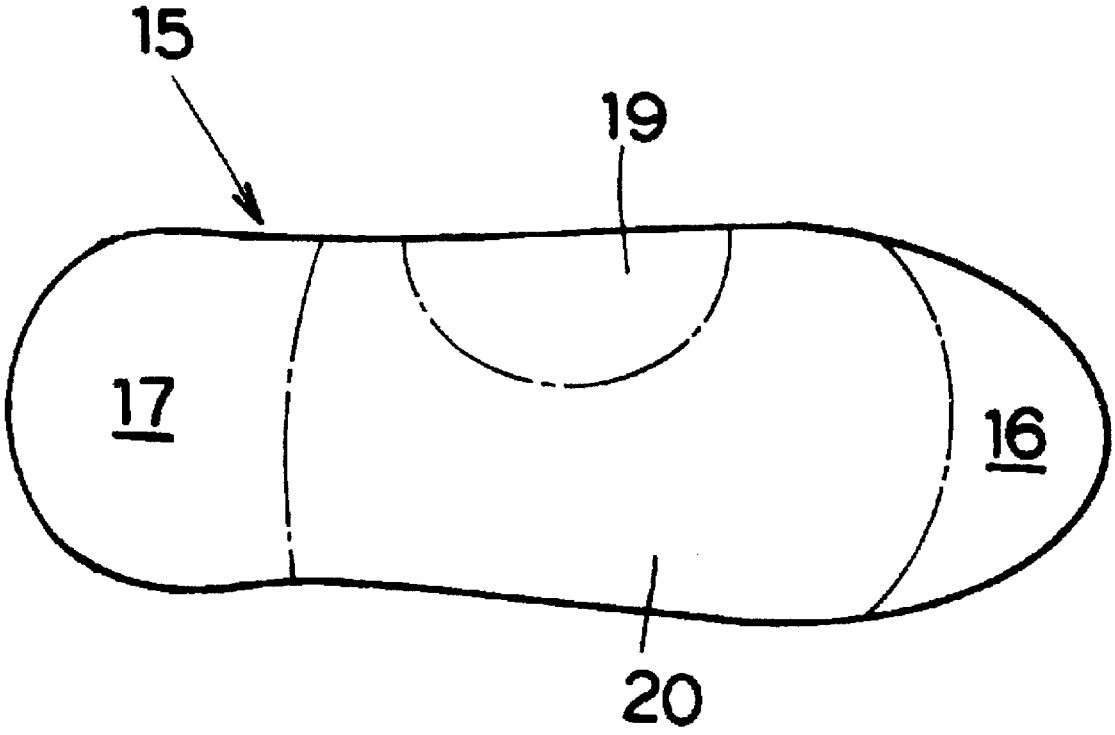
FIG. 2 is a schematic bottom view of a sole portion of the pile sock according to the embodiment of the present invention.

FIGS. 1 and 2 show an embodiment of a pile sock according to the present invention.

The pile sock 11 according to the present embodiment comprises a leg part 12 into which an ankle is to be inserted and a bag shaped foot part 13 in connection with the leg part 12, into which a foot is to be inserted. The foot part 13 is composed of an instep portion 14 and a sole portion 15 in connection with said instep portion 14.

Said sole portion 15 comprises a toe-side section 16 located in a toe side of a foot, a heel-side section 17 located in a heel side of a foot, and an intermediate section located therebetween in connection with those sections. Said intermediate section 18 is further divided into an arch region 19 corresponding to an arch of a foot and a remaining ground contact region 20 to be brought into contact to the ground side.

Said foot part 13 is knitted almost thoroughly in pile stitches. That is, the instep portion 14 and the sole portion 15 are knitted mainly in the pile stitches. In specific, in the sole portion 15, the toe-side section 16 and the heel-side section 17 are knitted completely in the pile stitches. The intermediate section 18 is knitted so that pile stitch segments and plain stitch (plain weave) segments are arranged in a lattice pattern. The pile stitch segment PA is formed into convex, while the plain stitch segment PL is formed into concave. In this case, the arch region 19 has a smaller area of the pile stitch segments PAs than an area of the plain stitch segments PLs. That is, the arch region 19 is knitted mainly in the plain stitches. On the other hand, the ground contact region 20, in contrast to the arch region 19, has a larger area of the pile stitch segments PAs than an area of the plain stitch segments PLs. This means that the ground contact region 20 is mainly made up of the pile stitch segments PAs. It is to be noticed that each of the regions in the instep portion 14 and in the sole portion 15 corresponding respectively to the arch region 19 is provided with a rubber braided annularly thereinto. The rubber is provided in order to prevent a slippage.

Further, a fiber used for said pile stitch or plain stitch may be, for example, "Coolmax" (trade mark) manufactured by Du Pont. Said fiber is excellent in water absorption properties and quick-drying properties, and thus well suited for a sock material. Other materials, such as "Rotest" (trade mark) available from Asahi Chemical Industry Co., Ltd., may be also used for the sock material. Said fiber has an excellent deodorizing capability and is durable in washing.

It should be appreciated that each of the above-mentioned pile stitch segments PAs is composed of a texture with the same thickness.

Since being composed of pile texture as a whole, the pile sock 11 with a configuration described above can provide excellent cushioning properties and moisture-absorption characteristics (sweat-absorption characteristics). Further, since the sole portion 15 has been knitted mainly in pile stitches, it has a function for preventing a slippage in addition to said cushioning properties and said moisture-absorption characteristics. Especially, the sole portion 15 can provide a user with a preferable feeling as a whole since it has been divided into the sections 16 and 17 with exclusive pile stitches, the section 20 with pile stitches as a majority, and the section 19 with plain stitches as a majority. This is because there are generated a stronger and a weaker senses of compression (i.e. a difference in pressure) depending on the sections. There is also an effect that in the toe-side section 16 and the heel-side section 17, the pile stitches work more efficiently to prevent the slippage. The strength thereof has become sufficiently high.

In this configuration, the ground contact region 20 and the arch region 19 are to obtain good air permeability since they are incorporated throughout with the plain stitch segments. In addition, the feeling of compression becomes lighter, so as to reduce the feeling of exhaustion after a long time wearing of the sock.

Further, the arch region 19 has more plain stitches because the arch of the foot would not contact the ground. As a result, the air permeability can be further improved. At the same time, the arch region 19, differently from the other region, has its pile protrusions made emphasized, which is to stimulate arch of the foot. It brings about an effect of stimulating a pressure point of the foot. It also can lighten the sense of squeeze.

Consequently, said pile sock can adjust itself to fit for the motion of the foot. The sock can fit around the foot inside the shoe, resulting in a reduced tiredness. The tiredness can be lighten with said sock in comparison with, for example, a case of such a sock where the piles compress throughout a sole of a foot. It is to be noticed that the texture of pile stitches arranged in the lattice pattern would not give any ill affection to the arch region 19 even though it becomes slightly less strong.

Accordingly, the pile sock with such configuration is suitable for light activities including walking or light works over long period.

The present invention is not limited to the above embodiment, but is applicable to any sock so far as it comprises a sole portion knitted so that the pile stitch segments and the plain stitch segments are distributed over the portion as mixed, wherein a magnitude of mixture (density level) should be segregated between the arch region and the ground contact region. The present invention makes advantage of the characteristics of the plain stitch segment, such as a small squeezing force and thin texture thereof, to be applied to a sole portion of a pile stitch sock.

Effect of the Invention

According to the present invention, the pressure to be sensed in the sole portion can be varied so as to be stronger or weaker depending on the location, thus lightening the feeling of tiredness during wearing. Further, a pile sock with excellent air permeability may be provided.

What is claimed is:

1. A pile sock having a sole portion comprising:

a toe-side section knitted in pile stitches;

a heel-side section knitted in pile stitches; and an intermediate section arranged between said toe-side section and said heel-side section, said intermediate section comprising an arch region and a ground contact region, said pile sock characterized in that said intermediate section is knitted so that pile stitch segments and plain stitch segments are distributed as mixed over said section, wherein said arch region has a larger area of the plain stitch segments than an area of the pile stitch segments, while said ground contact region has a larger area of the pile stitch segments than an area of the plain stitch segments.

2. A pile sock in accordance with claim 1, in which said intermediate section is knitted so that said pile stitch segments and said plain stitch segments are arranged in a lattice pattern.

* * * * *